US009039229B2

(12) United States Patent
Xu

(10) Patent No.: US 9,039,229 B2
(45) Date of Patent: May 26, 2015

(54) LED LAMP FIXTURE

(71) Applicant: Dong Guan Bright Yin Hiciy Lighting Co., Ltd, Dongguan, Guangdong (CN)

(72) Inventor: Shuisheng Xu, Dongguan (CN)

(73) Assignee: Dong Guan Bright Yin Hiciy Lighting Co., Ltd, Dongguan (CN)

( * ) Notice: Subject to any disclaimer, the term of this patent is extended or adjusted under 35 U.S.C. 154(b) by 76 days.

(21) Appl. No.: 13/890,251

(22) Filed: May 9, 2013

(65) Prior Publication Data

US 2014/0146529 A1 May 29, 2014

(30) Foreign Application Priority Data

Nov. 28, 2012 (CN) ..... 2012 2 0647176 U

(51) Int. Cl.
*F21K 99/00* (2010.01)

(52) U.S. Cl.
CPC ..... *F21K 9/10* (2013.01)

(58) Field of Classification Search
CPC ..... F21K 9/30
USPC ..... 362/217.1–217.17
See application file for complete search history.

(56) References Cited

U.S. PATENT DOCUMENTS

| | | | | |
|---|---|---|---|---|
| 8,240,890 | B2 * | 8/2012 | Tsai | 362/382 |
| 2005/0276052 | A1 * | 12/2005 | Shimada et al. | 362/294 |
| 2008/0259607 | A1 * | 10/2008 | Shimada et al. | 362/276 |
| 2009/0290352 | A1 * | 11/2009 | Wu et al. | 362/294 |
| 2011/0286225 | A1 * | 11/2011 | Konishi et al. | 362/398 |
| 2011/0317408 | A1 * | 12/2011 | Chen | 362/217.14 |
| 2012/0002415 | A1 * | 1/2012 | Nelson et al. | 362/235 |
| 2012/0044706 | A1 * | 2/2012 | Tsai | 362/382 |
| 2013/0002164 | A1 * | 1/2013 | Galluccio et al. | 315/294 |
| 2013/0294059 | A1 * | 11/2013 | Galluccio et al. | 362/218 |

* cited by examiner

*Primary Examiner* — Thomas A Hollweg

(57) ABSTRACT

An LED lamp fixture is provided with a frame; a plurality of bulb sockets mounted on the frame; and a plurality of LED lights each mounted between the bulb socket and a predetermined position of the frame opposite to the bulb socket. Each LED lights includes a front recess and two side grooves. Each bulb socket includes a housing releasably fastened in the recess, two flexible side wings on both sides of the housing respectively, and a spring activated button for extending or retracting the side wings so that the side wings are releasably disposed in the side grooves.

5 Claims, 9 Drawing Sheets

LED LAMP FIXTURE

BACKGROUND OF THE INVENTION

1. Field of the Invention

The invention relates to LED (light-emitting diode) lighting devices and more particularly to an LED lamp fixture having characteristics including being easy of disassembly and assembly.

2. Description of Related Art

LEDs are renowned for their long life and their ability to resist shock. Also, an LED consumes much less electrical power than fluorescent lamps. Therefore, LED lighting devices are gaining popularity worldwide. Recently, LEDs as a light source have been employed in outdoor lighting devices.

However, assembly and disassembly of an LED light are time consuming due to components thereof are fastened together in a complicated manner.

Thus, continuing improvements in the exploitation of LED light are constantly being sought.

SUMMARY OF THE INVENTION

It is therefore one object of the invention to provide an LED lamp fixture which is easy of disassembly and assembly for saving time and labor.

For achieving above and other objects, the invention provides an LED lamp fixture comprising a frame; an LED lamp fixture a frame; a plurality of bulb sockets mounted on the frame; and a plurality of LED lights each mounted between the bulb socket and a predetermined position of the frame opposite to the bulb socket; wherein each of the LED lights comprises a front recess and two side grooves; wherein each of the bulb sockets comprises a housing releasably fastened in the recess, two flexible side wings on both sides of the housing respectively, and a spring activated button for extending or retracting the side wings; and wherein the side wings are releasably disposed in the side grooves.

In one aspect of the invention, the LED light comprises a lamp unit, a rear cover threadedly secured to a rear end of the lamp unit, and a front cover threadedly secured to a front end of the lamp unit.

The above and other objects, features and advantages of the invention will become apparent from the following detailed description taken with the accompanying drawings.

DETAILED DESCRIPTION OF THE INVENTION

Figure 1:
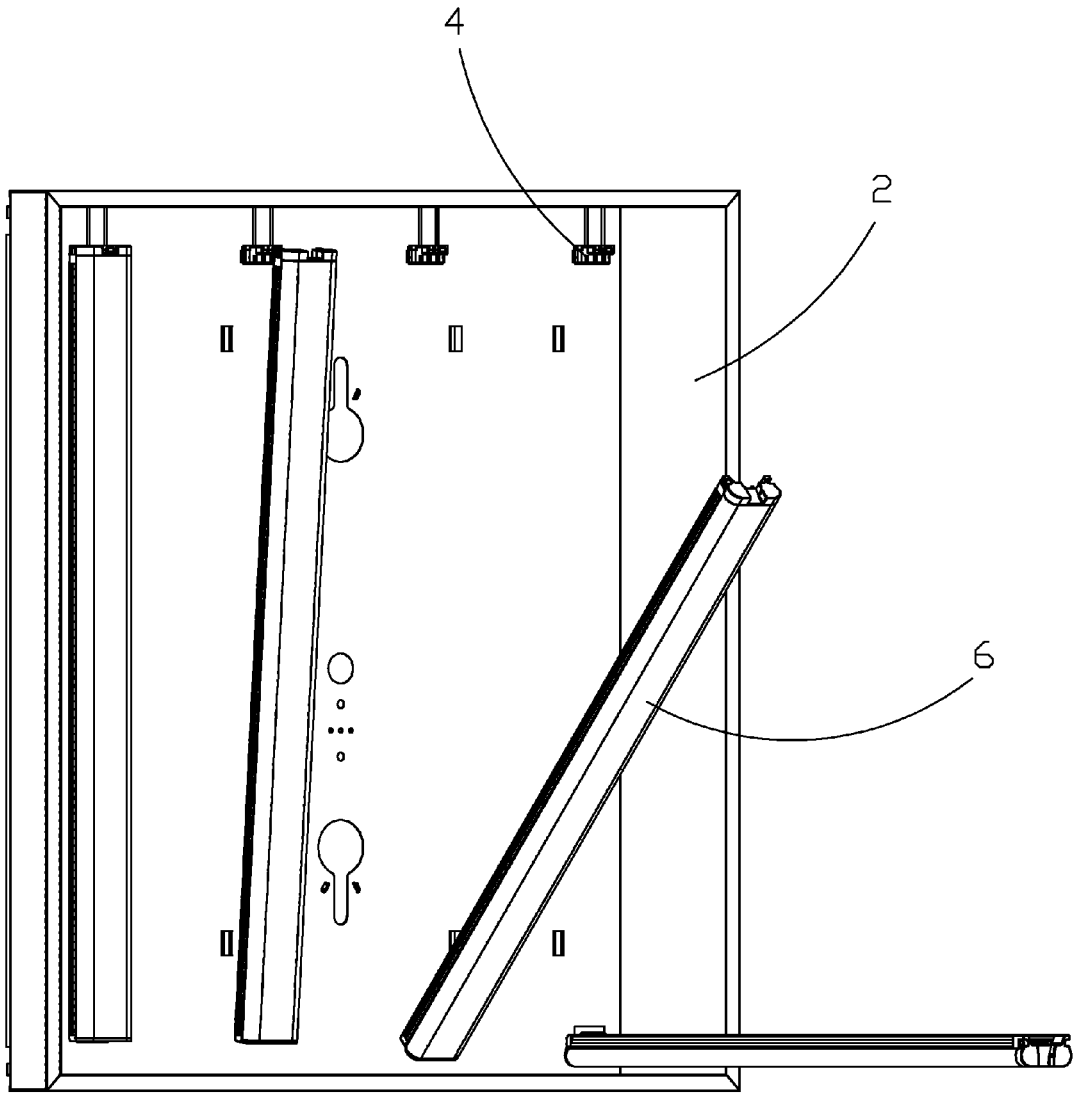
FIG. 1 is a bottom view of an LED lamp fixture according to the invention.
Figure 2:
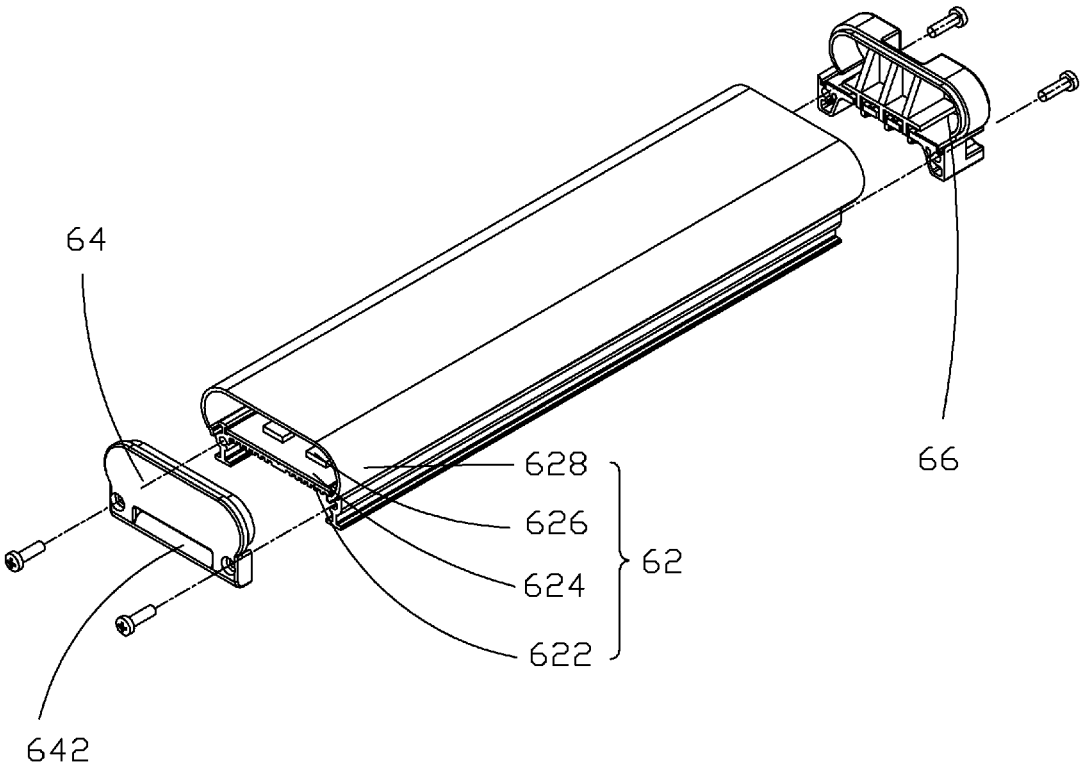
FIG. 2 is an exploded perspective view of the LED lamp fixture.
Figure 3:
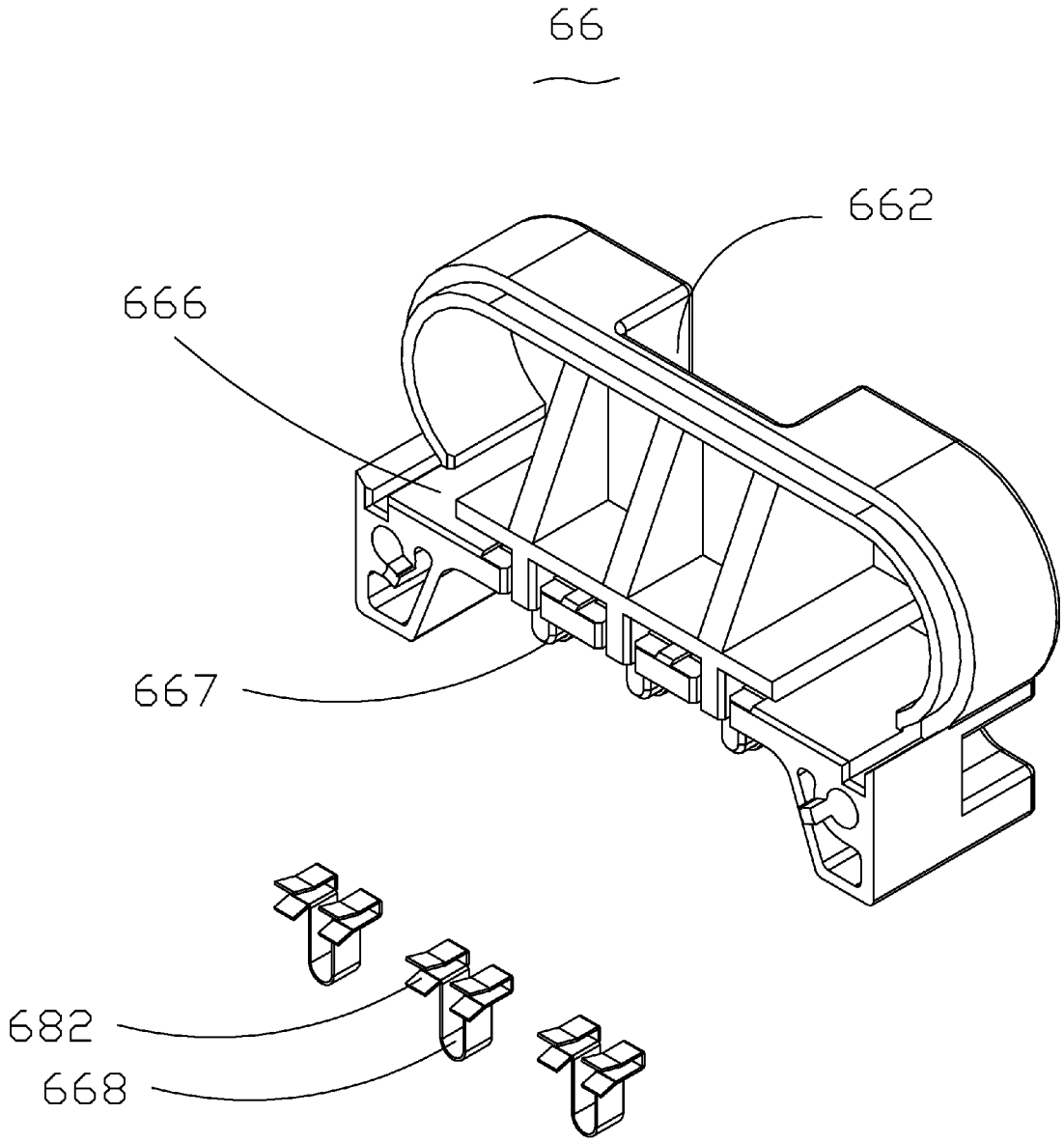
FIG. 3 is an exploded view of the front cover of the LED light of the LED lamp fixture.
Figure 4:
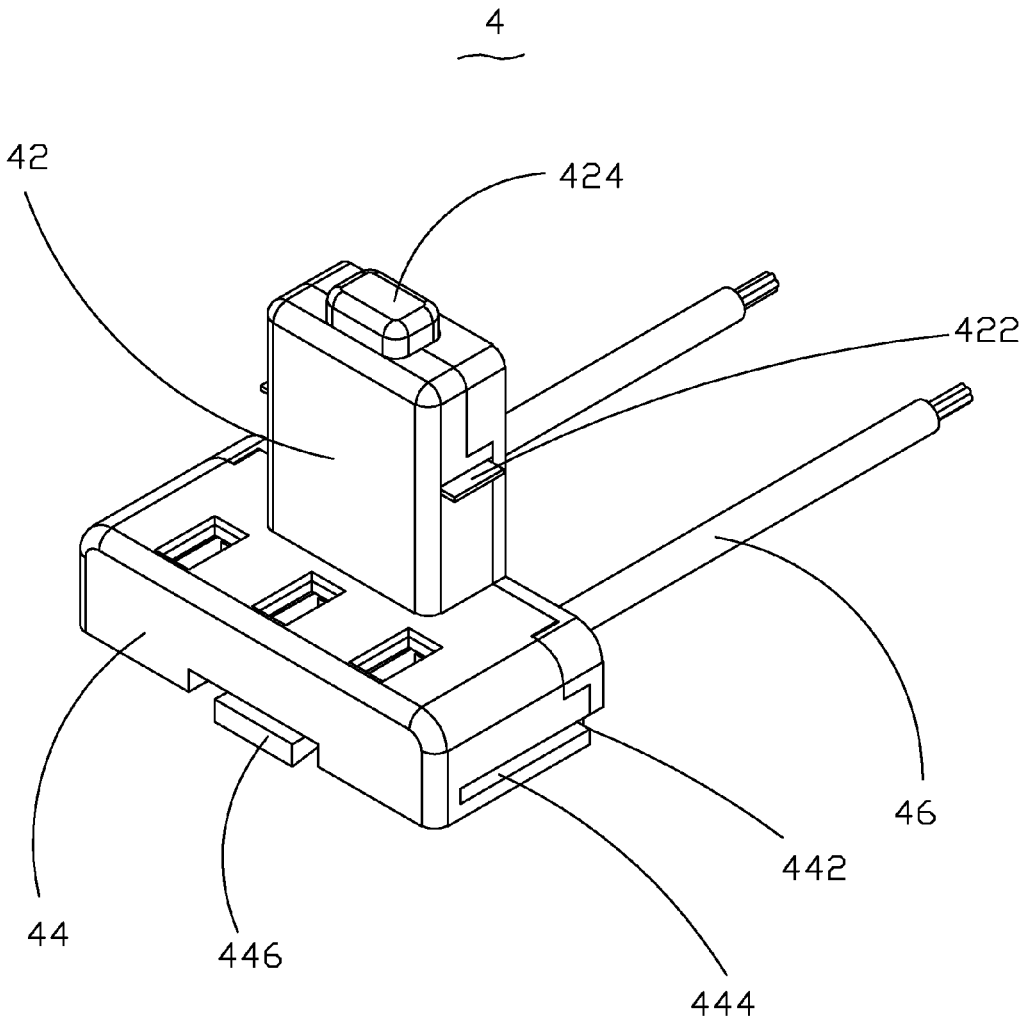
FIG. 4 is a perspective view of the bulb socket of the LED lamp fixture.
Figure 5:
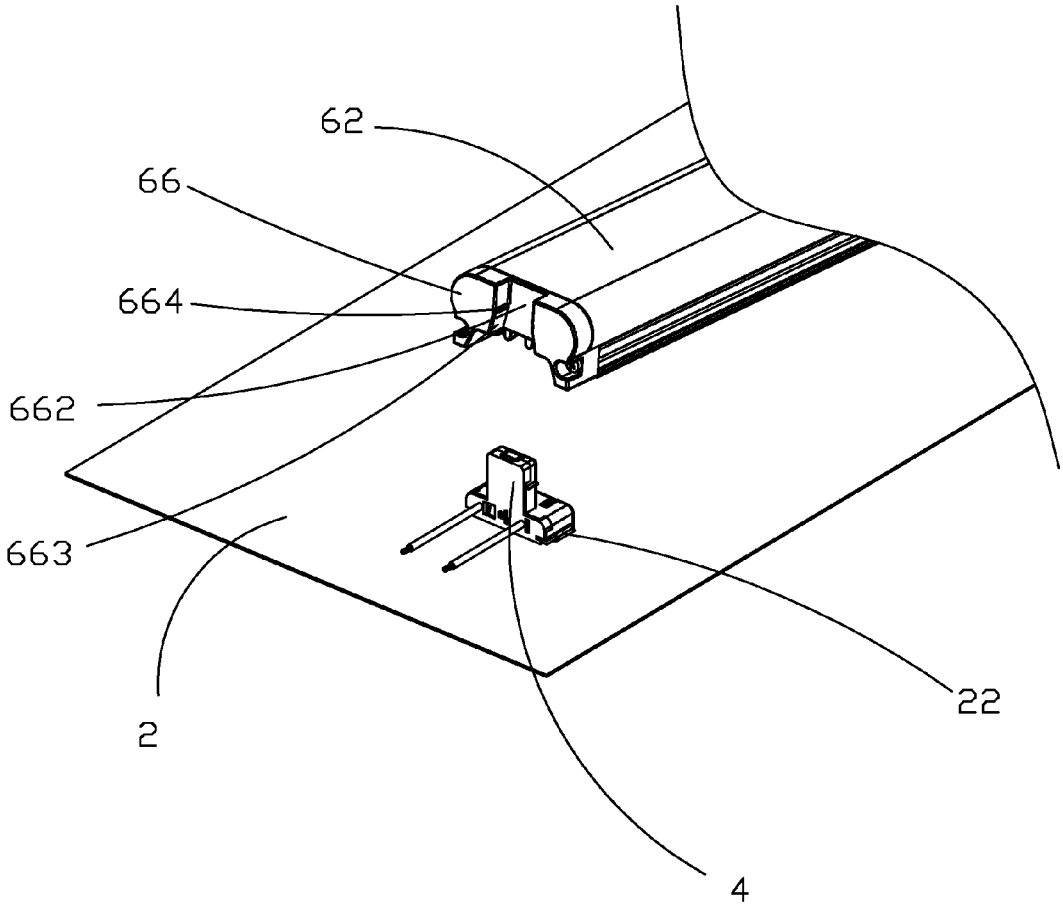
FIG. 5 is a perspective view depicting the front cover of the LED light to be secured to the bulb socket.
Figure 6:
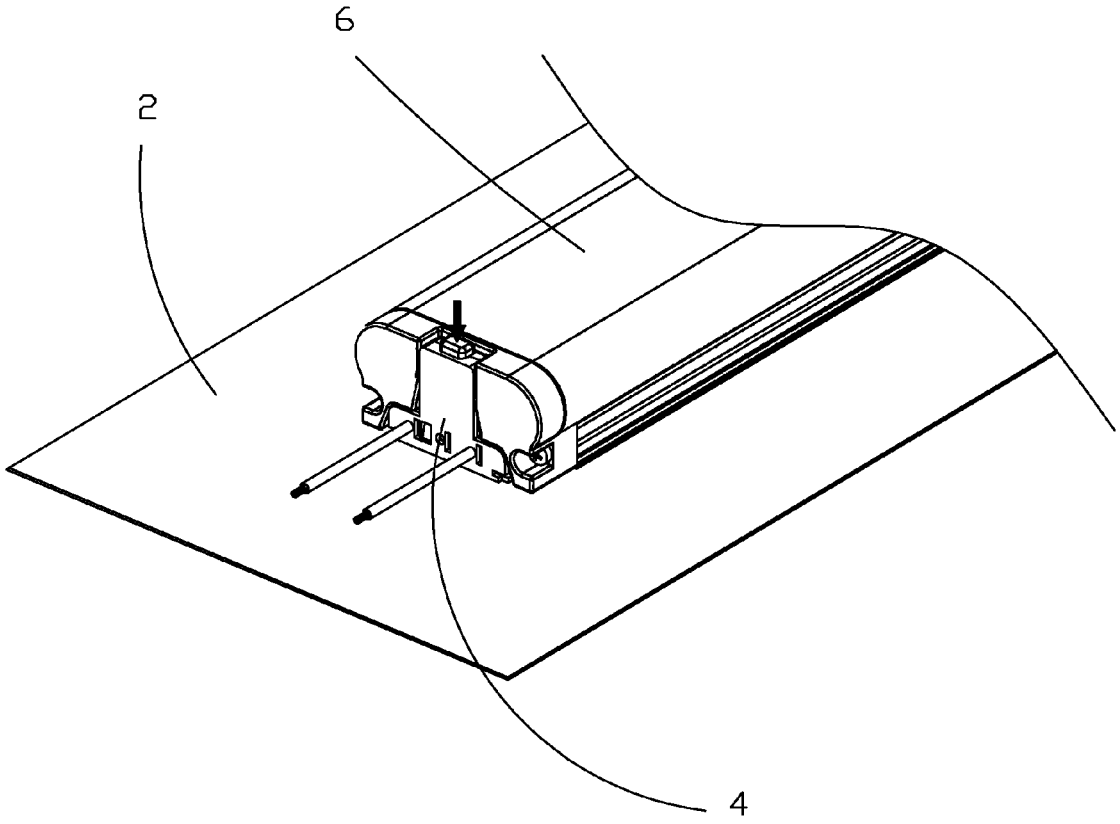
FIG. 6 is a view similar to FIG. 5 showing the front cover secured to the bulb socket.
Figure 7:
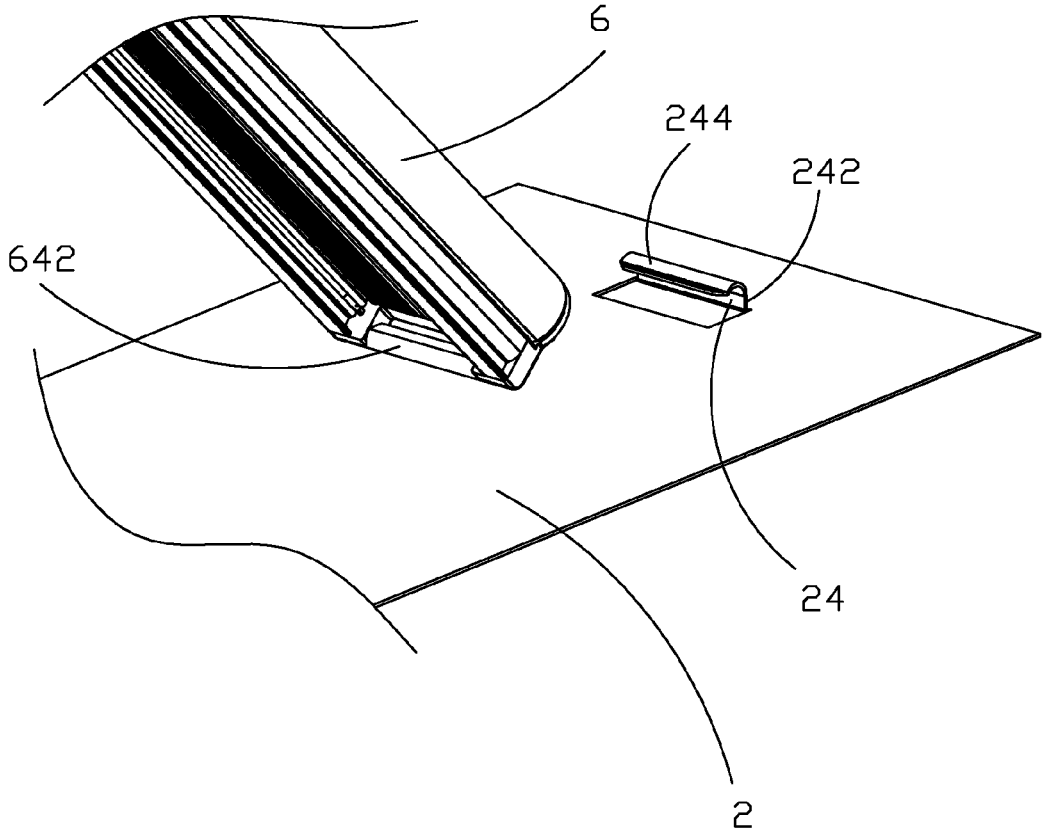
FIG. 7 is a perspective view depicting the rear end of the LED light to be secured to the fastening member of the frame.
Figure 8:
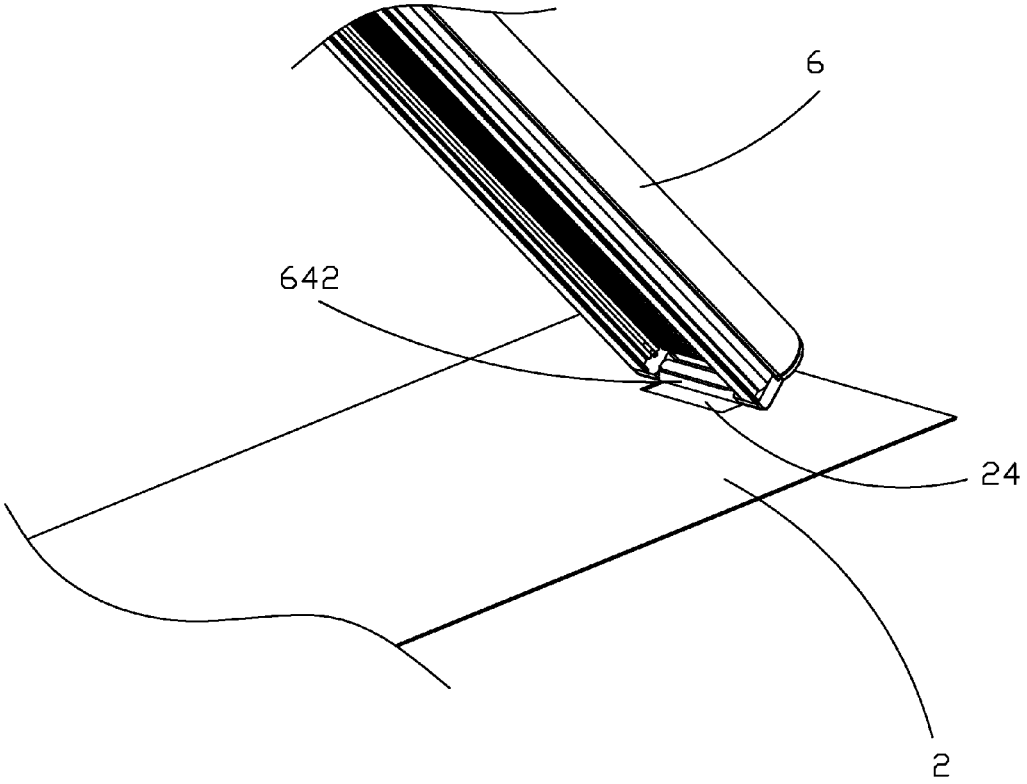
FIG. 8 is a view similar to FIG. 7 showing the rear end of the LED light entering the curved fastening member to be fastened.
Figure 9:
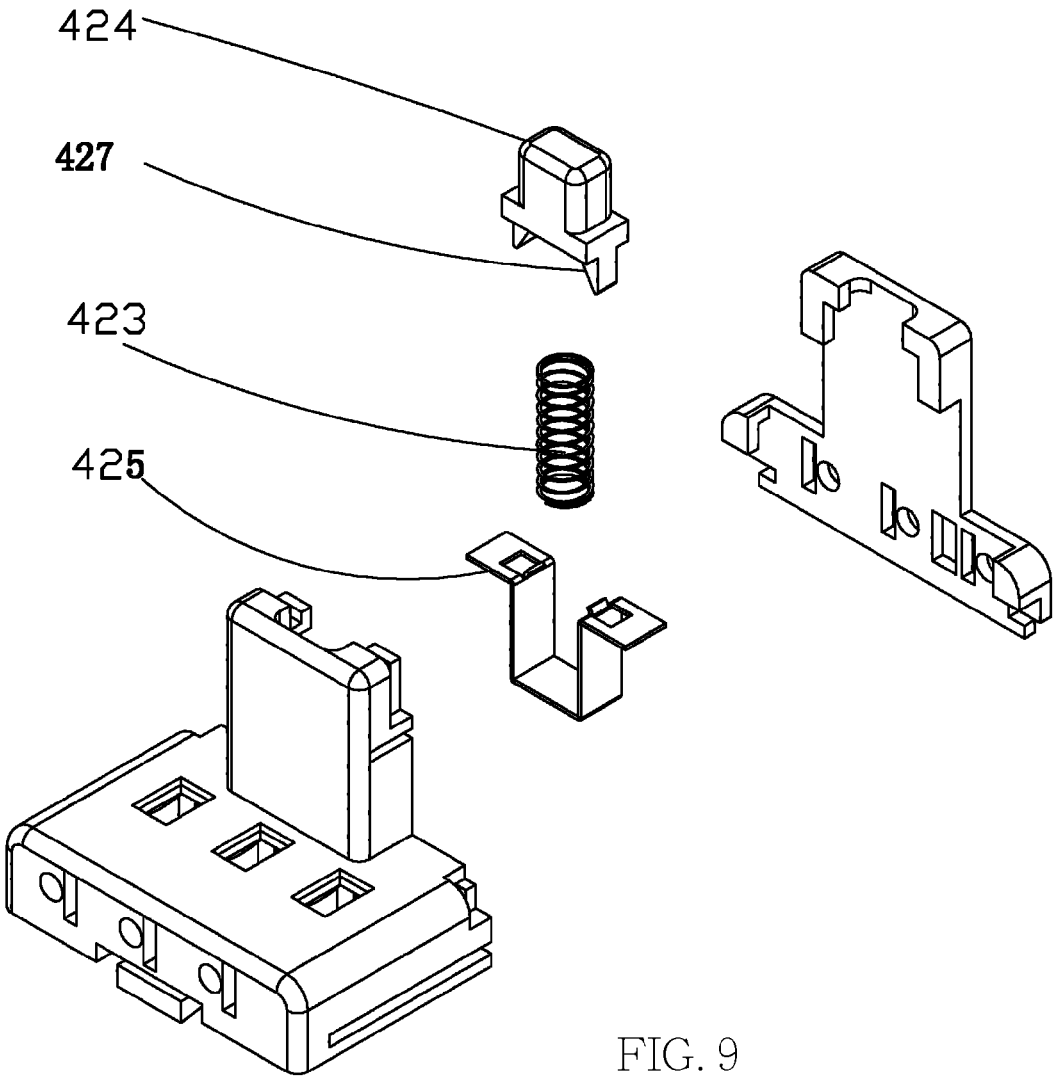
FIG. 9 is an exploded view of the bulb socket 4.

Referring to FIGS. 1 to 9, an LED lamp fixture in accordance with the invention comprises a rectangular frame 2, a plurality of bulb sockets 4 along one end of the frame 2, a plurality of fastening members 24 along the other end of the frame 2 opposing the bulb sockets 4, and a plurality of LED lights 6 each mounted between two opposite bulb socket 4 and fastening member 24 as discussed in detail below.

A plurality of a pair of mounting members 22 provided. The bulb socket 4 comprises a housing 42 including an end button 424, two latching members 427 on two sides of bottom, a flexible seat 425 under the button 424 and having two flexible side wings 422, and a helical spring 423 biased between the seat 425 and the button 424 so as to make the button 424 a spring depressible member; a connecting member 44 including two side openings 442 each having a grooved rail 444, and a latch 446 on a rear end of the bulb socket 4; and two wires 46 having one ends connected to a front end of the bulb socket 4. The fastening member 24 comprises a straight portion 242 and a curved portion 244 extending out of the straight portion 242. The mounting members 22 are inserted into the grooved rails 444 to fasten the bulb socket 4 and the frame 2 together.

The LED light 6 comprises a lamp unit 62, a rear cover 64 threadedly secured to a rear end of the lamp unit 62, and a front cover 66 threadedly secured to a front end of the lamp unit 62. The lamp unit 62 includes a base plate 622, a printed circuit board (PCB) 624 mounted on the base plate 622 and electrically connected to one ends of the wires 46 in the bulb socket 4, a plurality of LEDs 626 fastened on the PCB 624, and a grooved shaped shade 628 for concealing the base plate 622, the PCB 624 and the LEDs 626. The rear cover 64 includes a bottom rod 642 adapted to insert into the fastening member 24 to be held in place. The front cover 66 includes, on an outer surface, a front recess 662, two side grooves 664 each on an intermediate portion of each side of the recess 662, and two inclined surfaces 663 each extending from the groove 664 to an upper end of the recess 662. The front cover 66 further includes a support member 666, a plurality of top protrusions 667, and a plurality of U-shaped contacts 668 each having two bifurcation members 682 for securing to the support member 666. The bulb socket 4 and the front cover 66 are fastened together by inserting the housing 42 into the recess 662 by passing through the space defined by the inclined surfaces 663 until the flexible wings 422 are inserted into the side grooves 664. As a result, the LED light 6, the bulb sockets 4, and the frame 2 are fastened together. At this position, the latch 446 is secured to the base plate 622. The contacts 668 and the protrusions 667 are fastened together. Further, the contacts 668 are electrically connected to the PCB 624.

A disassembly of the LED light 6, the bulb sockets 4, and the frame 2 can be done by first pressing the button 424 to cause the wings 422 to clear the side grooves 664 and a plurality of subsequent steps which are reversed to steps discussed in above paragraph.

It is envisaged by the invention that both assembly and disassembly of the LED lamp fixture can be done in a time saving easy manner.

While the invention has been described in terms of preferred embodiments, those skilled in the art will recognize that the invention can be practiced with modifications within the spirit and scope of the appended claims.

What is claimed is:

1. An LED lamp fixture comprising:

a frame;

a plurality of bulb sockets mounted on the frame; and a plurality of LED lights each mounted between the bulb socket and a predetermined position of the frame opposite to the bulb socket;

wherein each of the LED lights comprises a front recess; two side grooves, a lamp unit, a rear cover threadedly secured to a rear end of the lamp unit, and a front cover threadedly secured to a front end of the lamp unit;

wherein each of the bulb sockets comprises a housing releasably fastened in the recess, two flexible side wings on both sides of the housing respectively, a spring activated button for extending or retracting the side wings, a connecting member including two side openings each having a grooved rail, two latching members on a bottom and having the two side wings, a flexible seat under the button, a biasing member biased between the seat and the button so as to make the button a spring depressible member;

wherein the frame includes a plurality of mounting members opposite to the bulb sockets, the plurality of a pair of mounting members are inserted into the grooved rails to fasten the bulb sockets and the frame together, a plurality of fastening members opposite to the bulb sockets wherein the side wings are releasably disposed in the side grooves;

wherein the rear cover includes a bottom rod capable of inserting into the fastening member to be held in place; and wherein each of the fastening members includes a straight portion and a curved portion extending out of the straight portion.

2. The LED lamp fixture of claim 1, wherein the lamp unit includes a base plate, a printed circuit board (PCB) mounted on the base plate, a plurality of LEDs formed on the PCB, and a shade for concealing the base plate, the PCB, and the LEDs.

3. The LED lamp fixture of claim 2, wherein the front cover includes the front recess, the two side grooves formed on both sides of the recess respectively, two inclined surfaces each extending from the side groove to an upper end of the recess, a support member, a plurality of top protrusions, and a plurality of U-shaped contacts electrically connected to the PCB, each contact having two bifurcation members for securing to the support member.

4. The LED lamp fixture of claim 3, wherein each of the bulb sockets comprises two wires having one ends disposed in the bulb socket to electrically connect to the PCB.

5. The LED lamp fixture of claim 4, wherein each of the bulb sockets comprises a rear latch secured to the base plate.

* * * * *